United States Patent [19]

Ray et al.

[11] 3,981,722

[45] Sept. 21, 1976

[54] AMORPHOUS ALLOYS IN THE U-CR-V SYSTEM

[75] Inventors: Ranjan Ray; Elisabeth Musso, both of Morristown, N.J.

[73] Assignee: Allied Chemical Corporation, Morris Township, N.J.

[22] Filed: Oct. 31, 1974

[21] Appl. No.: 519,887

[52] U.S. Cl. ..... 75/122.7
[51] Int. Cl.[2] ..... C22C 43/00
[58] Field of Search ..... 75/122.7

[56] References Cited

UNITED STATES PATENTS 2,756,489 7/1956 Morris ..... 75/122.7

OTHER PUBLICATIONS

"Reactor Materials" vol. 9 pp. 214 (Winter 1966–1967).

"Nuclear Science Abstracts" vol. 1 p. 1514, No. 13606.

*Primary Examiner*—Benjamin R. Padgett
*Assistant Examiner*—David Leland
*Attorney, Agent, or Firm*—David W. Collins; Ernest A. Polin

[57] ABSTRACT

Amorphous uranium-base alloys are disclosed having the general formula $U_xCr_yV_z$, where $x$ ranges from about 60 to 80 atom percent and $y$ and $z$ each range from about 0 to 40 atom percent, with the total of $y$ and $z$ ranging from about 20 to 40 atom percent. These amorphous alloys exhibit high strength and good creep resistance, and are thermally stable up to about 500°C.

4 Claims, 1 Drawing Figure

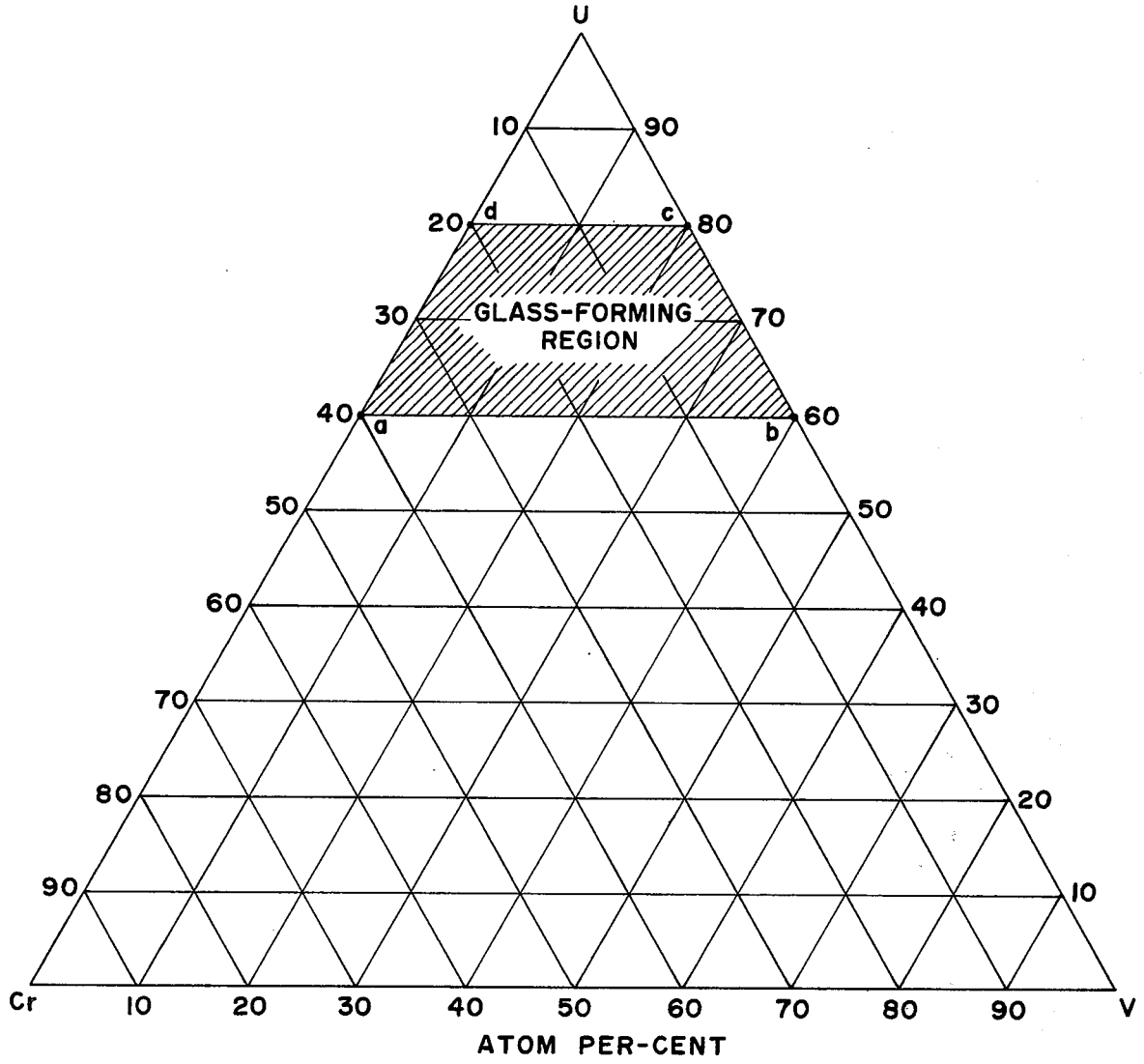
U
10
90
20
d
c
80
30
GLASS-FORMING
REGION
70
40
a
b
60
50
50
60
40
70
30
80
20
90
10
Cr
10
20
30
40
50
60
70
80
90
V
ATOM PER-CENT

AMORPHOUS ALLOYS IN THE U-CR-V SYSTEM

BACKGROUND OF THE INVENTION

I. Field of the Invention

The invention relates to amorphous metal alloys, and more particularly, to amorphous uranium-base alloys in the U-Cr-V system.

II. Description of the Prior Art

Investigations have demonstrated that it is possible to obtain solid amorphous metal alloys from certain compositions. An amorphous substance generally characterizes a non-crystalline or glassy substance, that is, a substance substantially lacking any long range order. In distinguishing an amorphous substance from a crystalline substance, X-ray diffraction measurements are generally suitably employed. Additionally, transmission electron micrography and electron diffraction can be used to distinguish between the amorphous and the crystalline state.

An amorphous metal produces an X-ray diffraction profile in which intensity varies slowly with diffraction angle. Such a profile is qualitatively similar to the diffraction profile of a liquid or ordinary window glass. On the other hand, a crystalline metal produces a diffraction profile in which intensity varies rapidly with diffraction angle.

These amorphous metals exist in a metastable state. Upon heating to a sufficiently high temperature, they crystallize with evolution of a heat of crystallization, and the X-ray diffraction profile changes from one having glassy or amorphous characteristics to one having crystalline characteristics.

It is possible to produce a metal which is totally amorphous or comrpises a two-phase mixture of the amorphous and crystalline state. The term "amorphous metal", as employed herein, refers to a metal which is at least 50 percent amorphous, and preferably 80 percent amorphous, but which may have some fraction of the material present as included crystallites.

Proper processing of certain alloys will produce a metal alloy in the amorphous state. One typical procedure is to cause the molten alloy to be spread thinly in contact with a solid metal substrate such as copper or aluminum so that the molten alloy loses its heat to the substrate. When the molten alloy is spread to a thickness of about 0.002 inch, cooling rates of the order of $10^{6}$°C/sec are achieved. See, for example, R. C. Ruhl, Vol. 1, *Materials Science and Engineering*, pp. 313–319 (1967), which discusses the dependence of cooling rates upon the conditions of processing molten alloys. Any process which provides a sufficiently high cooling rate, as on the order of $10^5$ to $10^{6}$°C/sec, can be used. Illustrative examples of procedures which can be used to make the amorphous metal alloys are the rotating double roll procedure described by H. S. Chen and C. E. Miller in Vol. 41, *Review of Scientific Instuments*, pp. 1237–1238 (1970) and the rotating cylinder technique described by R. Pond, Jr. and R. Maddin in Vol. 245, *Transactions of the Metallurgical Society*, AIME, pp. 2475–2476 (1969).

In the field of uranium technology, especially involving radiation applications such as reactor fuels, a variety of uranium-base alloys having crystalline or polycrystalline phases have been investigated. Most uranium-base single phase crystalline alloys are generally limited to a total alloying addition of about 5 weight percent. Single phase alloys are preferred for a variety of reason. For example, corrosion of uranium-base fuel is a well-known problem in water-cooled reactors. However, alloys that include elements that are insoluble in uranium (that is, form at least two phases) are less corrosion resistant than alloys that include elements that are soluble in uranium (that is, form a single phase alloy). Thus, in the binary U-Cr system, chromium, which is known to be an excellent corrosion inhibitor, is soluble only up to about 4 atom percent in the high temperature gamma phase at the eutectic temperature of about 859°C. The solubilities of the intermediate temperature beta phase and of the low (room) temperature alpha phase are even lower. This means that the corrosion resistant properties of chromium cannot be sufficiently exploited.

Single phase alloys are also required for optimum resistance to plastic deformation, which in turn depends upon, among other things, high creep resistance and high yield strength. The limited solubility of alloying elements in uranium precludes compositional optimization of these properties. Thermal and radiation stability are also important, and dimensional stability upon exposure to radiation is maximized by an isotropic structure, such as a cubic or pseudocubic (gamma or delta) structure. Cubic structures, however, are not always ideal for resistance to corrosion.

Amorphous metal alloys containing substantial amounts of iron, nickel, cobalt, vanadium and chromium have been described by H. S. Chen and D. E. Polk in a patent application, Ser. No. 318,146, filed Dec. 26, 1972, now U.S. Pat. No. 3,856,513, issued Dec. 24, 1974. While alloys are quite useful for a variety of applications, there is no suggestion that they are useful in nuclear applications. Moreover, recent investigations have shown that many metalloids, such as boron, phosphorus, carbon, silicon and aluminum, and many transition metals, such as iron, nickel, cobalt, titanium and zirconium, do not readily form amorphous alloys with uranium by liquid quenching.

There remains a need to fabricate uranium-base alloys having good mechanical and corrosion resistance properties, consistent with good thermal and dimensional stability.

SUMMARY OF THE INVENTION

In accordance with the invention, amorphous uranium-base alloys are formed from compositions having from about 60 to 80 atom percent uranium and about 0 to 40 atom percent each of chromium and vanadium, with the total of chromium and vanadium ranging from about 20 to 40 atom percent, and with a maximum of about 10 atom percent by other alloying elements, such as metalloids and transition metals replacing the chromium and vanadium. Preferably, the amorphous uranium base alloys have the general formula $U_xCr_yV_z$, where $x$ ranges from about 60 to 80 atom percent and $y$ and $z$ each range from about 0 to 40 atom percent. Alloys within this composition range evidence high mechanical strength and good creep resistance, and are thermally stable up to about 500°C. Preferred compositions also include $U_xCr_y$, where $x$ is as defined above and $y$ ranges from about 20 to 40 atom percent, and $U_xV_z$, where $x$ is as defined above and $z$ ranges from about 20 to 40 atom percent.

Being amorphous, these alloys are isotropic, and accordingly evidence dimensional stability. These amorphous alloys also evidence good corrosion resistance compared with the alloys in polycrystalline form.

Alloys containing chromium are especially resistant to corrosion by both tap water and salt water.

BRIEF DESCRIPTION OF THE DRAWINGS

The FIGURE is a ternary phase diagram, in atom percent, of the system U-Cr-V, depicting the glass-forming region.

DETAILED DESCRIPTION OF THE INVENTION

Shown in the FIGURE is a ternary phase diagram of the system U-Cr-V. The polygonal region designated *a-b-c-d-a* encompasses the glass-forming region as determined for this system and includes compositions of the general formula $U_xCr_yV_z$. Outside this composition region, either a substantial degree of amorphousness for this ternary system is not attained or the desired properties of mechanical strength, corrosion resistance, ductility, etc. are unacceptably reduced.

The compositional boundaries of the polygonal region are described as follows: $x$ ranges from about 60 to 80 atom percent and $y$ and $z$ each range from about 0 to 40 atom percent, with the total of $y$ and $z$ ranging from about 20 to 40 atom percent. Examples of amorphous compositions falling within this region include $U_{70}Cr_{30}$, $U_{60}Cr_{40}$, $U_{70}V_{30}$ and $U_{70}V_{15}Cr_{15}$.

While the purity of all materials described is that found in normal commercial practice, it is contemplated that minor additions of other alloying elements may be made without an unacceptable reduction of the desired properties. More specifically, up to about a maximum of about 10 atom percent of chromium and/or vanadium in the uranium base alloy may be replaced by at least one of the metalloid elements, such as phosphorus, boron, carbon, aluminum, silicon, tin, germanium, indium, beryllium and antimony, and/or at least one of the transition metals listed in the Periodic Table in Groups IB to VIIB and Group VIII.

The glasses are formed by cooling an alloy melt of appropriate composition at a rate of about $10^5$ to $10^6$°C/sec. A variety of techniques are available, as is well-known in the art, for fabricating splat-quenched foils and rapid-quenched continuous ribbons, wire, sheet, etc. Typically, a particular composition is selected, powders of the requisite elements (or of materials that decompose to form the elements) in the desired proportions are melted and homogenized, and the molten alloy is rapidly quenched on a chill surface, such as a rotating cylinder, or in a chilled fluid. The glasses may be formed in air or moderate vacuum. Other atmospheric conditions, such as inert gases, may also be employed.

The uranium-base amorphous alloys of the present invention evidence high mechanical strength and high corrosion resistance, as compared with their crystalline counterparts. These alloys are also ductile and are thermally stable up to about 500°C. Since they are isotropic, these alloys exhibit good dimensional stability against thermal and radiation effects. Accordingly, these alloys find use in nuclear applications, such as fuel elements for reactors and the like.

EXAMPLES

An arc-splat unit for melting and liquid quenching high temperature reactive metal alloys was used. The unit, which was a conventional arc-melting button furnace modified to provide "hammer and anvil" splat quenching of alloys under inert atmosphere, included a vacuum chamber connected with a diffusion pumping system. The quenching was accomplished by providing a flat-surfaced water-cooled copper hearth on the floor of the chamber and a pneumatically driven copper-block hammer positioned above the molten alloy. As is conventional, arc-melting was accomplished by negatively biasing a copper shaft provided with a non-consumable tungsten tip inserted through the top of the chamber and by positively biasing the bottom of the chamber. All alloys were prepared directly by repeated arc-melting of constituent elements. A single alloy button (about 200 mg) was remelted and then "impact-quenched" into a foil about 0.004 inch thick by the hammer situated just above the molten pool. the cooling rate attained by this technique was about $10^5$ to $10^6$°C/sec. The foils were checked for amorphousness by X-ray diffraction and DTA (differential thermal analysis). Hardness was measured by the diamond pyramid technique, using a Vickers-type indenter consisting of a diamond in the form of a square-based pyramid with an included angle of 136° between opposite faces.

The hardness data (in DPH) and ductility for amorphous alloys prepared by the above procedure are compared with alloys of the same composition in the crystalline state in Table I.

TABLE I

Hardness Data and Ductility of Uranium Base Alloys

| Composition (Atom Percent) | Hardness (DPH) | Ductility |
|---|---|---|
| $U_{70}Cr_{30}$ - amorphous | 460 | Ductile to bending* |
| $U_{70}Cr_{30}$ - crystalline | 355 | Brittle |
| $U_{70}V_{30}$ - amorphous | 442 | Ductile to bending* |
| $U_{70}V_{30}$ crystalline | 360 | Brittle |

*A 0.002 to 0.003 inch thick foil can be bent to permanent deformation without failure.

Corrosion resistance was determined by exposure of the amorphous alloys to 3.5 percent salt water for 1600 hours and to tap water for 1600 hours. The results for amorphous alloys are shown in Table II. Data for crystalline alloys of the same composition are included for comparison.

TABLE II

Corrosion Resistance of Uranium-Base Alloys

| Composition (Atom Percent) | 3.5% Salt Water 1600 Hours | Tap Water 1600 Hours |
|---|---|---|
| $U_{70}Cr_{30}$ - amorphous | no tarnish or corrosion | no tarnish or corrosion |
| $U_{70}Cr_{30}$ - crystalline | severely corroded | severely corroded |
| $U_{60}Cr_{30}$ - amorphous | no tarnish or corrosion | no tarnish or corrosion |
| $U_{70}V_{30}$ - amorphous | moderately corroded | moderately corroded |
| $U_{70}V_{30}$ - crystalline | severely corroded | severely corroded |
| $U_{60}Cr_{20}V_{20}$ - crystalline | severely corroded | severely corroded |

What is claimed is:

1. A uranium base metal alloy which is at least 50 percent amorphous comprising about 60 to 80 atom percent of uranium and about 20 to 40 atom percent of chromium and/or vanadium, and a maximum of about 10 atom percent of other alloying elements replacing chromium and/or vanadium.

2. The alloy of claim 1 in which the alloy consists essentially of the composition $U_xCr_yV_z$, where $x$ ranges from about 60 to 80 atom percent and $y$ and $z$ each range from 0 to about 40 atom percent, with the total of $y$ and $z$ ranging from about 20 to 40 atom percent.

3. The alloy of claim 2 in which the alloy consists essentially of the composition $U_xCr_y$, where $x$ ranges from about 60 to 80 atom percent and $y$ ranges from about 20 to 40 atom percent.

4. The alloy of claim 2 in which the alloy consists essentially of the composition $U_xV_z$, where $x$ ranges from about 60 to 80 atom percent and $z$ ranges from about 20 to 40 atom percent.

* * * * *